US007273112B2

(12) United States Patent
Saur et al.

(10) Patent No.: US 7,273,112 B2
(45) Date of Patent: Sep. 25, 2007

(54) ELECTRIC POWER TOOL HAVING A DRIVE MECHANISM THAT CAN BE SWITCHED AMONG DRILLING, PERCUSSION DRILLING, AND CHISELING MODES OF OPERATION

(75) Inventors: Dietmar Saur, Gomaringen (DE); Helmut Heinzelmann, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/214,964

(22) Filed: Aug. 30, 2005

(65) Prior Publication Data

US 2006/0048955 A1 Mar. 9, 2006

(30) Foreign Application Priority Data

Sep. 3, 2004 (DE) ..... 10 2004 042 732
Dec. 6, 2004 (DE) ..... 10 2004 058 686

(51) Int. Cl.
*E02D 7/06* (2006.01)

(52) U.S. Cl. ..... 173/48; 173/104; 173/109

(58) Field of Classification Search ..... 173/48, 173/104, 109, 114, 205
See application file for complete search history.

(56) References Cited

U.S. PATENT DOCUMENTS 4,446,931 A * 5/1984 Bleicher et al. ..... 173/48
4,719,976 A * 1/1988 Bleicher et al. ..... 173/109
5,373,905 A * 12/1994 Bleicher et al. ..... 173/109
5,379,848 A 1/1995 Rauser
6,460,627 B1 10/2002 Below et al.

FOREIGN PATENT DOCUMENTS

EP 1 157 788 11/2001

* cited by examiner

*Primary Examiner*—Rinaldi I. Rada
*Assistant Examiner*—Nathaniel Chukwurah
(74) *Attorney, Agent, or Firm*—Michael J. Striker

(57) ABSTRACT

An electric power tool has a drive mechanism switchable back and forth among a drilling, a percusion drilling, and a chiseling mode of operation; a drive shaft performing a rotary motion; a percusion mechanism provided with a drive bearing; a serrated sleeve supported axially displaceably in the drive bearing of the percussion mechanism and transmitting a rotary motion of the drive shaft to the drive bearing of the percusion mechanism when it is in an axial position corresponding to the chiseling or percusion drilling modes of operation; and an axially displaceable serrated shaft supported in the drive bearing, so that the serrated sleeve transmits to the serrated shaft the rotary motion of the drive shaft when the serrated shaft is in axial position corresponding to the drilling or percussion drilling modes of operation.

6 Claims, 1 Drawing Sheet

ELECTRIC POWER TOOL HAVING A DRIVE MECHANISM THAT CAN BE SWITCHED AMONG DRILLING, PERCUSSION DRILLING, AND CHISELING MODES OF OPERATION

BACKGROUND OF THE INVENTION

The invention relates to an electric power tool, in particular drill hammer and/or chisel hammer, which has a drive mechanism that can be switched among drilling, percussion drilling, and chiseling modes of operation.

Electric power tools, in particular drill hammers and/or chisel hammers provided with a drive mechanism are generally known in the art. It is believed that the existing electric power tools of this type can be further improved.

SUMMARY OF THE INVENTION

Accordingly, it is an object of the invention to provide a drive mechanism of this kind which entails the simplest possible effort and expense for producing and assembling its components.

In keeping with these objects and with others which will become apparent hereinafter, one feature of the present invention resides, briefly stated, in an electric power tool, in particular a drill hammer and/or chisel hammer having a drive mechanism for switching back and forth among the drilling, percussion drilling, or chiseling modes of operation, in which a serrated sleeve is axially displaceably supported in a drive bearing for a percussion mechanism and transmits a rotary motion of a drive shaft to the drive bearing of the percussion mechanism when it is in an axial position corresponding to the modes of operation of chiseling or percussion drilling, and an axially displaceable serrated shaft is supported in the drive bearing, to which serrated shaft the serrated sleeve transmits the rotary motion of the drive shaft when the serrated shaft is in an axial position corresponding to the modes of operation of drilling or percussion drilling.

This support of the drive bearing for the percussion mechanism, the serrated shaft and the serrated sleeve according to the invention makes do with very few bearing points, making the arrangement very compact and reducing its production costs.

The novel features which are considered as characteristic for the present invention are set forth in particular in the appended claims. the invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
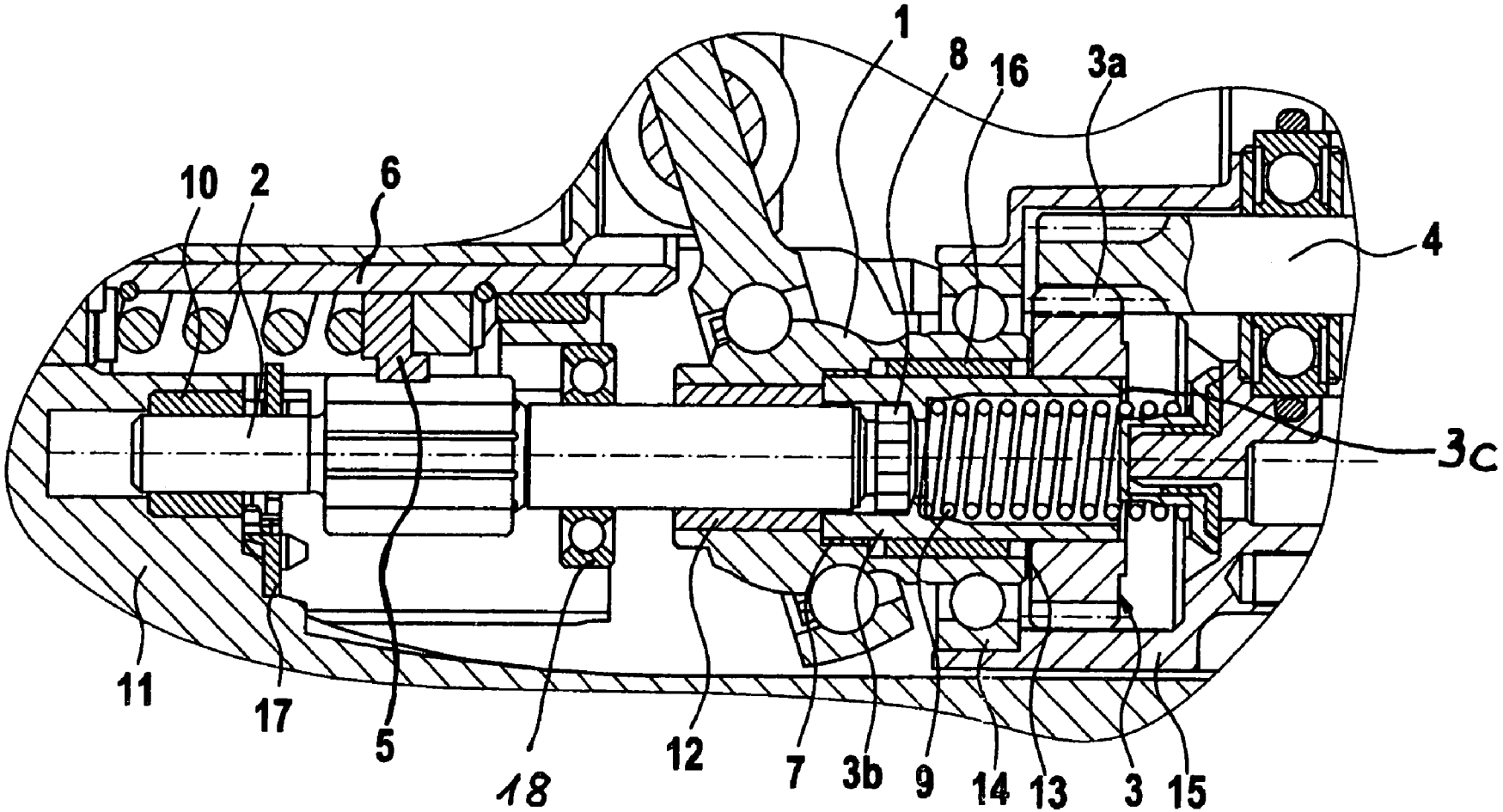
FIG. 1 of the drawings is a view showing a detail of a drill hammer and/or chisel hammer, in accordance with the present invention.

The drawing shows a detail of a drill hammer and/or chisel hammer in accordance with the present invention. As can be seen from the drawing, among other elements, a drive bearing 1 for a percussion mechanism, an axially displaceable serrated shaft 2, and a serrated sleeve 3, which is coupled to a drive shaft 4 and driven to rotate by it, are provided.

The serrated sleeve 3 may be embodied in one or two parts. In a two-part version, the serrated sleeve 3 comprises a spur gear 3*a*, which is operatively connected to the drive shaft 4, and a hollow cylinder 3*b*, on which the spur gear 3*a* is seated with a press fit. The hollow cylinder 3*b* may be embodied as an extruded part or produced by powder metallurgy, and the spur gear 3*a* is preferably produced by metal-cutting machining or by powder metallurgy.

The serrated shaft 2 is axially displaceably supported in the drive bearing 1 via a bearing 12. The serrated shaft 2 is operatively connected to the hollow cylinder 3*b* of the serrated sleeve 3. A rotary motion of the serrated shaft 2 is transmitted via a spur gear 5 to a hammer barrel 6, in which pistons and beaters of the percussion mechanism are typically located, and which transmits the rotary motion to a tool holder (not shown here).

The arrangement of the components as shown in the drawing illustrates the mode of operation for percussion drilling (hammer drilling). The serrated sleeve 3 and the serrated shaft 2 are each put into a position such that on the one hand the hollow cylinder 3*b*, in the coupling region 7, transmits its rotary motion to the drive bearing 1 for the percussion mechanism. On the other, the serrated shaft 2 is driven to rotate by the rotating serrated sleeve 3 via slaving teeth 8 in the hollow cylinder 3*b*, and the rotary motion of the serrated shaft 2 is transmitted to the hammer barrel 6 via the spur gear 5. The spur gear 5 is embodied as a running gear, and the slaving teeth 8 are embodied as a coupling gear.

If the serrated shaft 2 is shifted to the left in its axial position in the plane of the drawing, the slaving teeth 8 of the serrated shaft 2 and of the serrated sleeve 3 no longer mesh, and thus the serrated shaft 2 is no longer driven to rotate by the serrated sleeve 3, and consequently rotary motion is no longer transmitted from the serrated shaft 2 to the hammer barrel 6. During that time, however, the hollow cylinder 3*b* of the serrated sleeve 3 is still coupled with to the drive bearing 1 of the percussion mechanism, so that the rotary motion of the serrated sleeve 3 is converted into a percussion motion of the percussion mechanism. In that case, the mode of operation is chiseling.

If the serrated shaft 2 is shifted to the right in the plane of the drawing together with the serrated sleeve 3, counter to the spring 9 located in the serrated sleeve 3, then the hollow cylinder 3*b* of the serrated sleeve 3 is disengaged from the coupling region 7 of the drive bearing 1 of the percussion mechanism, so that now the rotary motion of the serrated sleeve 3 is no longer transmitted to the drive bearing 1. The percussion mechanism is thus switched off. However, since the serrated shaft 2 is still coupled to the serrated sleeve 3 via the slaving teeth 8, the rotary motion of the serrated sleeve 3 is converted via the serrated shaft 2 into a rotary motion of the hammer barrel 6. In this position of the serrated shaft 2 and the serrated sleeve 3, the mode of operation is drilling.

The bearing of the serrated shaft 2 is effected on the side remote from the drive bearing 1, by means of a bearing (such as a needle sleeve 10) that is press-fitted into the gearbox 11. The bearing of the serrated shaft 2 in the drive bearing 1 is effected by a bearing 12, which is press-fitted into the drive bearing 1. The ratio of the length to the diameter of this bearing 12 is greater than 1. The bearing 12 may be embodied for instance as a slide bearing or as a needle bearing.

The toothing between the serrated shaft 2 and the hollow cylinder 3*b* of the serrated sleeve 3 in the region of the slaving teeth 8 is offset in the direction of the drive shaft 4 from the coupling region 7 between the drive bearing 1 and the serrated sleeve 3. This makes the creative shaping of the serrated sleeve 3 easier, since the geometries inside the serrated sleeve 3 do not influence one another during the extrusion.

An axial shift of the spur gear 3*a* of the serrated sleeve 3 to the left in the plane of the drawing, that is, in the direction of the chiseling position, is prevented by providing that a rearward stop 3*c* is integrally formed onto the spur gear 3*a*. The toothing of the spur gear 3*a* and of the drive shaft 4 has a helix angle, and the obliquity of the toothing extends such that in clockwise operation of the power tool (which is true for the great majority of applications), the axial component of the torque is operative in the percussion direction, that is, in the direction of the front part of the power tool (to the left in the plane of the drawing). As a consequence, the stop 3*c* on the spur gear 3*a* is pressed on its face end onto the hollow cylinder 3*b* of the serrated sleeve 3, so that even under heavy stress in the percussion mode (chiseling), the spur gear is secured against axial offset.

The relative motion between the serrated sleeve 3 and the drive bearing 1 is absorbed, in particular in the drilling mode of operation, by means of a bearing 16 embodied for instance as a needle ring, which is located between the hollow cylinder 3*b* of the serrated sleeve 3 and the drive bearing 1.

Since in drilling, no forces (course of moment in percussion drilling) originate in the percussion mechanism, the serrated sleeve 3 can be partly pushed out of the drive bearing 1 to the rear, in the direction of the drive shaft 4, and the bearing width can thus be reduced. In the chiseling mode of operation, the serrated shaft 2 is locked by a securing baffle 17, which is located in the region of the bearing 10 and is secured to the gearbox 11, so that a so-called spindle lock is implemented.

The coupling 8 between the serrated shaft 2 and the drive bearing 1 is located radially below this bearing 16. The radial location of a plurality of bearings makes for a very space-saving arrangement of the various components 1, 2, 3, 8, 16.

A further bearing 18 is fixed (for instance pressed on) on the serrated shaft 2, between the bearing 12 in the drive bearing and the bearing 10 located on the gearbox. Via this bearing 18, by means of a switching mechanism not shown in the drawing, the axial positioning of the serrated shaft 2 is done for the modes of operation of drilling, percussion drilling, and chiseling.

It will be understood that each of the elements described above, or two or more together, may also find a useful application in other types of constructions differing from the types described above.

While the invention has been illustrated and described as embodied in an electric power tool having a drive mechanism that can be switched among drilling, percussion drilling, and chiseling modes of operation, it is not intended to be limited to the details shown, since various modifications and structural changes may be made without departing in any way from the spirit of the present invention.

Without further analysis, the foregoing will reveal fully revela the gist of the present invention that others can, by applying current knowledge, readily adapt it for various applications without omitting features that, from the standpoint of prior art, fairly constitute essential characteristics of the generic or specific aspects of the invention.

What is claimed as new and desired to be protected by Letters Patent is set forth in the appended claims:

1. An electric power tool, comprising a drive mechanism switchable back and forth among a drilling, a percussion drilling, and a chiseling mode of operation; a drive shaft performing a rotary motion; a percussion mechanism provided with a drive bearing; a serrated sleeve supported axially displaceably in said drive bearing of said percussion mechanism and transmitting a rotary motion of said drive shaft to said drive bearing of said percussion mechanism when the drive bearing is in an axial position corresponding to the chiseling of percussion drilling modes of operation; and an axially displaceable serrated shaft supported in said drive bearing, so that said serrated sleeve transmits to said serrated shaft the rotary motion of said drive shaft when said serrated shaft is in axial position corresponding to the drilling or percussion drilling modes of operation, wherein the serrated shaft is driven by rotary motion of the serrated sleeve via slaving teeth, and wherein the serrated shaft is axially displaceable with respect to the serrated sleeve so that the slaving teeth are disengaged, thereby providing said chiseling mode of operation.

2. An electric power tool as define in claim 1, wherein said serrated sleeve has a spur gear which is operatively connected to said drive shaft, and a hollow cylinder on which said spur gear is disposed.

3. An electric power tool as define in claim 2, wherein said spur gear is formed as a metal-cutting-machining or powder-metallurgy produce part, and said hollow cylinder is formed as an extrude or powder-metallurgy produce part.

4. An electric power tool as define in claim 3, wherein said spur gear said drive shaft operatively connected to said spur gear have a spiral gearing such that in clockwise operation a torque has an axial component in a percussion direction of the tool.

5. An electric power tool as define in claim 1, and further comprising a bearing which couples said serrated shaft to said drive bearing and has a ratio of length to diameter which is greater than 1.

6. An electric power tool as define in claim 1; and further comprising and coupling which couples said serrated shaft and said serrated sleeve, and a bearing for said serrated sleeve in said drive bearing, said coupling which couples said serrated shaft and said serrated sleeve and said bearing for said serrated sleeve in said drive bearing being located radially in one another.

* * * * *